US008759661B2

(12) United States Patent
Van Buskirk et al.

(10) Patent No.: US 8,759,661 B2
(45) Date of Patent: Jun. 24, 2014

(54) SYSTEM AND METHOD FOR AUDIO SYNTHESIZER UTILIZING FREQUENCY APERTURE ARRAYS

(75) Inventors: James Edwin Van Buskirk, Austin, TX (US); Jennifer Hruska, Arlington, MA (US); Jason Jordan, Maiden, MA (US); Al Joelson, Reading, MA (US); Borislav Zlatkov, Lexington, MA (US)

(73) Assignee: Sonivox, L.P., Cumberland, RI (US)

( * ) Notice: Subject to any disclaimer, the term of this patent is extended or adjusted under 35 U.S.C. 154(b) by 284 days.

(21) Appl. No.: 13/218,727

(22) Filed: Aug. 26, 2011

(65) Prior Publication Data

US 2012/0166187 A1 Jun. 28, 2012

Related U.S. Application Data

(60) Provisional application No. 61/378,765, filed on Aug. 31, 2010, provisional application No. 61/379,094, filed on Sep. 1, 2010.

(51) Int. Cl.
*G10H 5/02* (2006.01)

(52) U.S. Cl.
USPC ..... 84/659

(58) Field of Classification Search
USPC ..... 84/622, 659
See application file for complete search history.

(56) References Cited

U.S. PATENT DOCUMENTS

| | | | | |
|---|---|---|---|---|
| 4,185,531 | A | 1/1980 | Oberheim et al. | |
| 4,649,783 | A * | 3/1987 | Strong et al. | 84/606 |
| 4,988,960 | A | 1/1991 | Tomisawa | |
| 5,194,684 | A * | 3/1993 | Lisle et al. | 84/659 |
| 5,448,010 | A * | 9/1995 | Smith, III | 84/622 |
| 5,524,057 | A | 6/1996 | Akiho et al. | |
| 5,684,260 | A * | 11/1997 | Van Buskirk | 84/604 |
| 5,777,255 | A * | 7/1998 | Smith et al. | 84/661 |
| 5,811,706 | A | 9/1998 | Van Buskirk et al. | |
| 5,841,387 | A | 11/1998 | Van Buskirk | |
| 5,890,125 | A | 3/1999 | Davis et al. | |
| 5,917,919 | A | 6/1999 | Rosenthal | |
| 6,008,446 | A | 12/1999 | Van Buskirk et al. | |
| 6,104,822 | A | 8/2000 | Melanson et al. | |
| 7,110,554 | B2 | 9/2006 | Brennan et al. | |
| 7,359,520 | B2 | 4/2008 | Brennan et al. | |
| 2003/0063759 | A1 | 4/2003 | Brennan et al. | |

(Continued)

OTHER PUBLICATIONS

Karplus and Strong, "Digital Synthesis of Plucked-String and Drum Timbres," Computer Music Journal, vol. 7, No. 2 (Summer 1983), pp. 43-55, The MIT Press.

(Continued)

*Primary Examiner* — Jeffrey Donels
(74) *Attorney, Agent, or Firm* — Finnegan, Henderson, Farabow, Garrett & Dunner, LLP.

(57) ABSTRACT

A system and method for audio synthesizer utilizing frequency aperture cells (FAC) and frequency aperture arrays (FAA). In accordance with an embodiment, an audio processing system can be provided for the transformation of audio-band frequencies for musical and other purposes. In accordance with an embodiment, a single stream of mono, stereo, or multi-channel monophonic audio can be transformed into polyphonic music, based on a desired target musical note or set of multiple notes. At its core, the system utilizes an input waveform(s) (which can be either file-based or streamed) which is then fed into an array of filters, which are themselves optionally modulated, to generate a new synthesized audio output.

25 Claims, 9 Drawing Sheets

(56) References Cited

U.S. PATENT DOCUMENTS

| | | | |
|---|---|---|---|
| 2003/0108214 | A1 | 6/2003 | Brennan et al. |
| 2004/0131203 | A1 | 7/2004 | Liljeryd et al. |
| 2005/0111683 | A1 | 5/2005 | Chabries et al. |
| 2005/0132870 | A1 | 6/2005 | Sakurai et al. |
| 2008/0260175 | A1 | 10/2008 | Elko |
| 2008/0304676 | A1 | 12/2008 | Alves et al. |
| 2009/0220100 | A1 | 9/2009 | Ohta et al. |
| 2009/0323976 | A1 | 12/2009 | Asada et al. |
| 2010/0124341 | A1 | 5/2010 | Kano |
| 2012/0099732 | A1 | 4/2012 | Visser |
| 2012/0128177 | A1 | 5/2012 | Truman et al. |
| 2012/0166187 | A1 | 6/2012 | Van Buskirk et al. |
| 2012/0288124 | A1 | 11/2012 | Fejzo et al. |

OTHER PUBLICATIONS

Jaffe and Smith, "Extensions of the Karplus-Strong Plucked-String Algorithm," Computer Music Journal, vol. 7, No. 2 (Summer 1983), pp. 56-69, The MIT Press.

Office Action dated Dec. 19, 2012, in U.S. Appl. No. 13/196,690.

Office Action dated Jul. 18, 2013, in U.S. Appl. No. 13/196,690.

* cited by examiner

AN EXAMPLE PITCH DISBURSEMENT TRANSFORM FILTER

ANOTHER EXAMPLE OF A PITCH DISBURSEMENT TRANSFORM FILTER

AN ILLUSTRATION SHOWING HOW THE FAA SYNTHESIS CAN BE COMBINED WITH OTHER SYNTHESIS METHODS

AN ILLUSTRATION SHOWING HOW THE FAA SYNTHESIS CAN BE COMBINED WITH OTHER SYNTHESIS METHODS

SYSTEM AND METHOD FOR AUDIO SYNTHESIZER UTILIZING FREQUENCY APERTURE ARRAYS

CLAIM OF PRIORITY

This application claims the benefit of priority to U.S. Provisional patent application titled "SYSTEM AND METHOD FOR AUDIO SYNTHESIZER UTILIZING FREQUENCY APERTURE ARRAYS", Application No. 61/378,765, filed Aug. 31, 2010; and U.S. Provisional patent application titled "SYSTEM AND METHOD FOR AUDIO SYNTHESIZER UTILIZING FREQUENCY APERTURE ARRAYS", Application No. 61/379,094, filed Sep. 1, 2010; each of which applications are herein incorporated by reference in their entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

Embodiments of the invention are generally related to music, audio, and other sound processing and synthesis, and are particularly related to a system and method for audio synthesizer utilizing frequency aperture cells (FAC) and frequency aperture cell arrays (FAA).

SUMMARY

Disclosed herein is a system and method for audio synthesizer utilizing frequency aperture cells (FAC) and frequency aperture arrays (FAA). In accordance with an embodiment, an audio processing system can be provided for the transformation of audio-band frequencies for musical and other purposes. In accordance with an embodiment, a single stream of mono, stereo, or multi-channel monophonic audio can be transformed into polyphonic music, based on a desired target musical note or set of multiple notes. At its core, the system utilizes an input waveform(s) (which can be either file-based or streamed) which is then fed into an array of filters, which are themselves optionally modulated, to generate a new synthesized audio output.

Advantages of various embodiments of the present invention over previous techniques include that the input audio source can be completely unpitched and unmusical, even consisting of just pure white noise or a person's whisper, and after being synthesized by the FAA have the ability to be completely musical, with easily recognized pitch and timbre components; and the use of a real-time streamed audio input to generate the input source which is to be synthesized. The frequency aperture synthesis approach allows for both file-based audio sources and real-time streamed input. The result is a completely new sound with unlimited scope because the input source itself has unlimited scope. In accordance with an embodiment, the system also allows multiple syntheses to be combined to create unique hybrid sounds, or accept input from a musical keyboard, as an additional input source to the FAA filters. Other features and advantages will be evident from the following description.

BRIEF DESCRIPTION OF THE FIGURES

FIG. 5A shows an example of a definite pitch signal, in accordance with an embodiment; while

DETAILED DESCRIPTION

Figure 1:
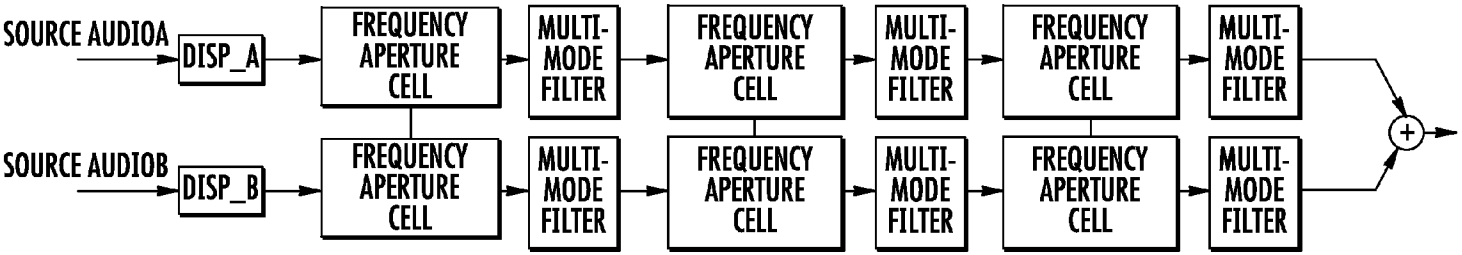
FIG. 1 shows a 2-series-by-3-parallel array of frequency aperture cells (FAC's), in accordance with an embodiment.

Disclosed herein is a system and method for audio synthesizer utilizing frequency aperture cells (FAC) and frequency aperture arrays (FAA). In accordance with an embodiment, an audio processing system can be provided for the transformation of audio-band frequencies for musical and other purposes. In accordance with an embodiment, a single stream of mono, stereo, or multi-channel monophonic audio can be transformed into polyphonic music, based on a desired target musical note or set of multiple notes. At its core, the system utilizes an input waveform(s) (which can be either file-based or streamed) which is then fed into an array of filters, which are themselves optionally modulated, to generate a new synthesized audio output.

An advantage of various embodiments of the present invention over previous techniques is how the input audio source can be completely unpitched and unmusical, even consisting of just pure white noise or a person's whisper, and after being synthesized by the FAA have the ability to be completely musical, with easily recognized pitch and timbre components. The output audio source is unlimited in its scope, and can include realistic instrument sounds such as violins, piano, brass instruments, etc., electronic sounds, sound effects, and sounds never conceived or heard before.

Other advantages of embodiments of the present invention over previous techniques are the use of a real-time streamed audio input to generate the input source which is to be synthesized. Previously, musical synthesizers have relied upon stored files (usually pitched) which consist of audio waveforms, either recorded (sample based synthesis) or algorithmically generated (frequency or amplitude modulated synthesis) to provide the audio source which is then synthesized. The frequency aperture synthesis approach allows for both file-based audio sources and real-time streamed input. The result is a completely new sound with unlimited scope because the input source itself has unlimited scope.

In order to facilitate pitched streamed audio input sources, in accordance with an embodiment the system also includes a dispersion algorithm which can take a pitched input source and make it unpitched and noise-like (broad spectrum). This signal then feeds into cells and filters of the FAA which further synthesizes the audio signal. This allows for a unique attribute in which a person can sing, whisper, talk or vocalize into the dispersion filter, which, when fed into the FAA filters and triggered by a keyboard or other source guiding the pitch components of the FAA synthesizer, can yield an output that sounds like anything, including a real instrument such as a piano, guitar, drumset, etc. The input source is not limited to vocalizations of course. Any pitched input source (guitar, drumset, piano, etc.) can be dispersed into broad spectrum noise and re-synthesized to produce any musical instrument output.

In accordance with an embodiment, the system also allows multiple syntheses to be combined to create unique hybrid sounds. Finally, embodiments of the invention include a method of using multiple impulse responses, mapped out across a musical keyboard, as an additional input source to the FAA filters, designed, but not limited to, synthesizing the first moments of a sound.

Introduction

White noise is a sound that covers the entire range of audible frequencies, all of which possess equal intensity. White noise is analogous to white light, which contains roughly equal intensities of all frequencies of visible light. An approximation to white noise is the static that appears between FM radio stations. Pink noise contains all frequencies of the audible spectrum, but with a decreasing intensity of roughly three decibels per octave. This decrease approximates the audio spectrum composite of acoustic musical instruments or ensembles.

In accordance with an embodiment, the system uses an array of audio frequency aperture cells, which separate noise components into harmonic and inharmonic frequency multiples. Much in the way that a prism can separate white light into it's constituent spectrum of frequencies, the resultant frequencies based on the material, internal feedback interference and spectrum of incoming light. Among other factors, frequency aperture cells (FAC's) do analogously with audio, based on their type, feedback properties, and the spectrum of incoming audio. Another aspect of the invention deals with the conversion of incoming pitched sounds into wide-band audio noise spectra, while at the same time preserving the intelligibility, sibilance, or transient aspect of the original sound, then routing the sound through the array of FAC's.

Previous techniques for dealing with both pitched and non-pitched audio input is known as subtractive synthesis, whereby single or multi-pole High Pass, Low Pass, Band Pass, Resonant and non-resonant filters are used to subtract certain unwanted portions from the incoming sound. In this technique, the subtractive filters usually modify the perceived timbre of the note, however the filter process does not determine the perceived pitch, except in the unusual case of extreme filter resonance. These filters are usually of type IIR, Infinite Impulse Response, indicating a delay line and a feedback path. Others who have employed noise routed through IIR filters are Kevin Karplus, Alex Strong (1983). "Digital Synthesis of Plucked String and Drum Timbres". Computer Music Journal (MIT Press) 7 (2): 43-55. doi:10.2307/3680062, incorporated herein by reference. Although arguably also subtractive, in this case the resonance of the filter usually determines the pitch as well as it affects the timbre. There have been various improvements to this technique, whereby certain filter designs are intended to emulate certain portions of their acoustic counterparts.

In accordance with an embodiment, the system provides an improvement to both of these musical processes, by employing arrays of frequency aperture cells. FAC's have the ability to transform a spectrum of related or unrelated, harmonic or inharmonic input frequencies into an arbitrary, and potentially continuously changing set of new output frequencies. There are no constraints on the type of filter designs employed, only that they have inherent slits of harmonic or in-harmonic frequency bands that separate desired frequency components between their input and output. Both FIR (Finite Impulse Response) and IIR (Infinite Impulse Response) type designs are employed within different embodiments of the FAC types. Musically interesting effects are obtained as individual frequency slit width, analogous to frequency spacing, and height, analogous to amplitude, are varied between FAC stages. FAC stages are connected in series and in parallel, and can each be modulated by specific modulation signals, such as LFO's, Envelope generators, or by the outputs of prior stages.

Frequency spacing from the output of the FAC is often not even (i.e. harmonic, hence the term "slit width" instead of "pitch" is used. "Slit width" can affect both the pitch, timbre or just one or the other, so the use of "pitch" is not appropriate in the context of an FAC array.

Frequency Aperture Arrays

In accordance with an embodiment, frequency aperture arrays (FAA's) are n series by m parallel connections of frequency aperture cells, and optionally other digital filters such as multimode HP/BP/LP/BR filters and/or resonators of varying type. The multi-mode filter can be omitted as an option.

Figure 2:
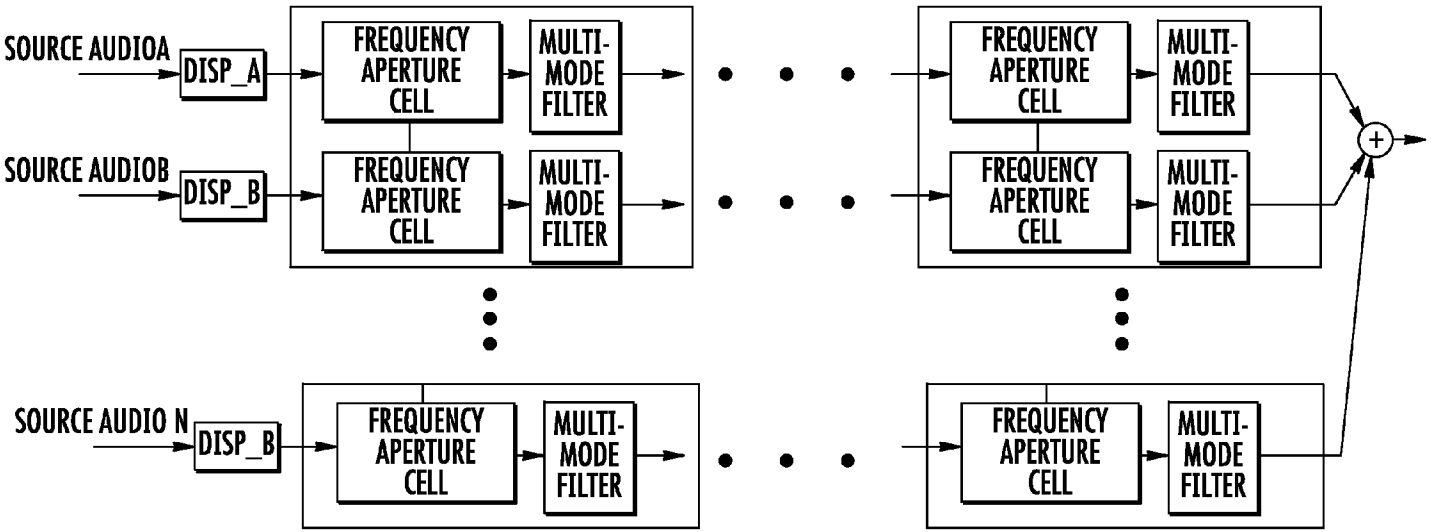
FIG. 2 shows an n-series-by-m-parallel array of frequency aperture cells (FAC's), in accordance with an embodiment.

FIG. 1 shows a 2-series-by-3-parallel array of frequency aperture cells (FAC's), in accordance with an embodiment; while FIG. 2 shows an n-series-by-m-parallel array of frequency aperture cells (FAC's), in accordance with an embodiment. As shown in FIGS. 1 and 2, each array is organized into n rows by m columns, representing n successive series connections of audio processing, the output of which is then summed with m parallel rows of processing. A channel of mono, stereo, or multi-channel source audio feeds each row. The source audio may be live audio or pre-loaded from a file storage system, such as on the hard drive of a personal computer. Each frequency aperture cell in the array is comprised of its own unique set of modulators for slit width, slit height and amplitude, as well as audio input, a cascade input, an audio output, transient impulse scaling, and a Frequency Aperture Filter.

Figure 3:
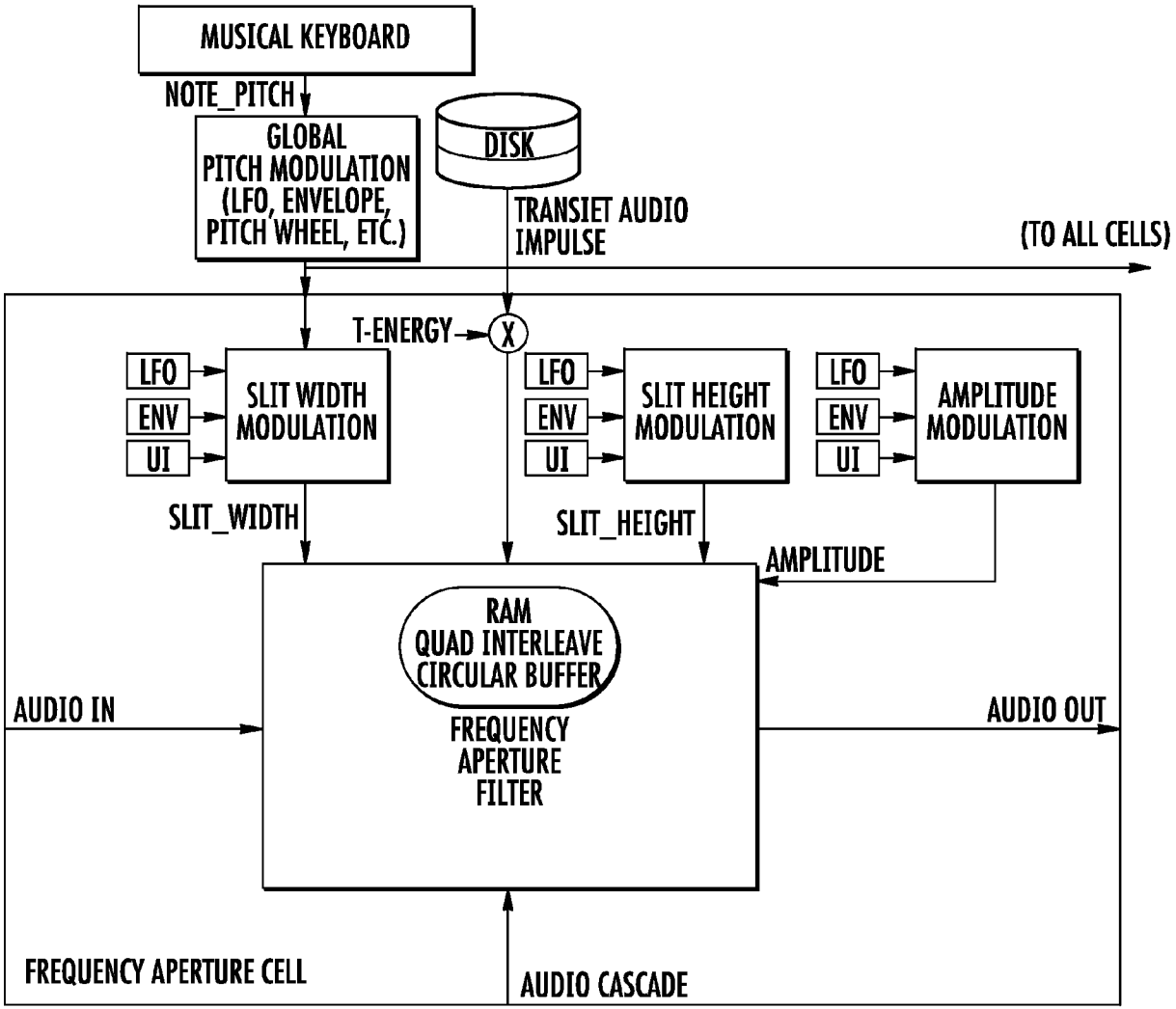
FIG. 3 shows a one of n-by-m frequency aperture cell (FAC), along with system connection, in accordance with an embodiment.

FIG. 3 shows a one of n-by-m frequency aperture cell (FAC), along with system connection, in accordance with an embodiment. Storage of control parameters, such as modulation and other musical controls, and source or impulse transient audio files come from a storage system, such as a hard drive or other storage device. A unique set of each of these files and parameters is loaded into runtime memory for each Frequency Aperture Cell in the array. The system may be built of software, hardware, or a combination of both. In a preferred embodiment, and for the purpose of conserving computational resources, a quad interleave buffer, and associated data structures can be deployed to facilitate a SIMD (Same Instruction Multiple Data) implementation, such as is required for optimal performance on Intel-based MAC and Windows based personal computers. With the data packed and unpacked into interleave channels of data, four channels can be processed simultaneously.

Frequency Aperture Cells

Each frequency aperture cell, with varying feedback properties, produces instantaneous output frequency based on both the instantaneous spectrum of incoming audio, as well as the specific frequency slits and resonance of the aperture filter. Two controlling properties are the frequency slit spacing (slit width) and the noise-to-frequency band ratio, or frequency (slit height).

An important distinction of constituent FAA cells is that their slit widths are not necessarily representative of the pitch of the perceived audio output. FAA cells may be inharmonic themselves, or in the case of two or more series cascaded harmonic cells of differing slit width, they may have their aperture slits at non-harmonic relationships, producing inharmonic transformations through cascaded harmonic cells. The perceived pitch is often a complex relationship of the slit widths and heights of all constituent cells and the character of their individual harmonic and inharmonic apertures. The slit width and height are as important to the timbre of the audio as they are to the resultant pitch.

In accordance with an embodiment, a system and method are provided that is an improvement to both of these musical processes, by employing arrays of frequency aperture filters. FAA's have the ability to transform a spectrum of related or unrelated, harmonic or inharmonic input frequencies into an arbitrary, and potentially continuously changing set of new output frequencies. There are no constraints on the type of filter designs employed, only that they have inherent slits of harmonic or in-harmonic frequency bands that separate desired frequency components between their input and output. Both FIR (Finite Impulse Response) and IIR (Infinite Impulse Response) type designs are employed within different embodiments of the FAA types. Musically interesting effects are obtained as individual frequency slit width, analogous to frequency spacing, and height, analogous to amplitude, are varied between FAC stages. In accordance with an embodiment, FAC stages are connected in series and in parallel, and can each be modulated by specific modulation signals, such as LFO's, Envelope generators, or by the outputs of prior stages.

Frequency Aperture Filters

In accordance with an embodiment, frequency aperture filters (FAF) may be embodied as single or multiple digital filters of either the IIR (Infinite Impulse Response) or FIR (Finite Impulse Response) type, or any combination thereof. One characteristic of the filters is that both timbre and pitch are controlled by the filter parameters, and that input frequencies of adequate energies that line up with the multiple passbands of the filter will be passed to the output of the collective filter, albeit of potentially differing amplitude and phase.

Figure 4:
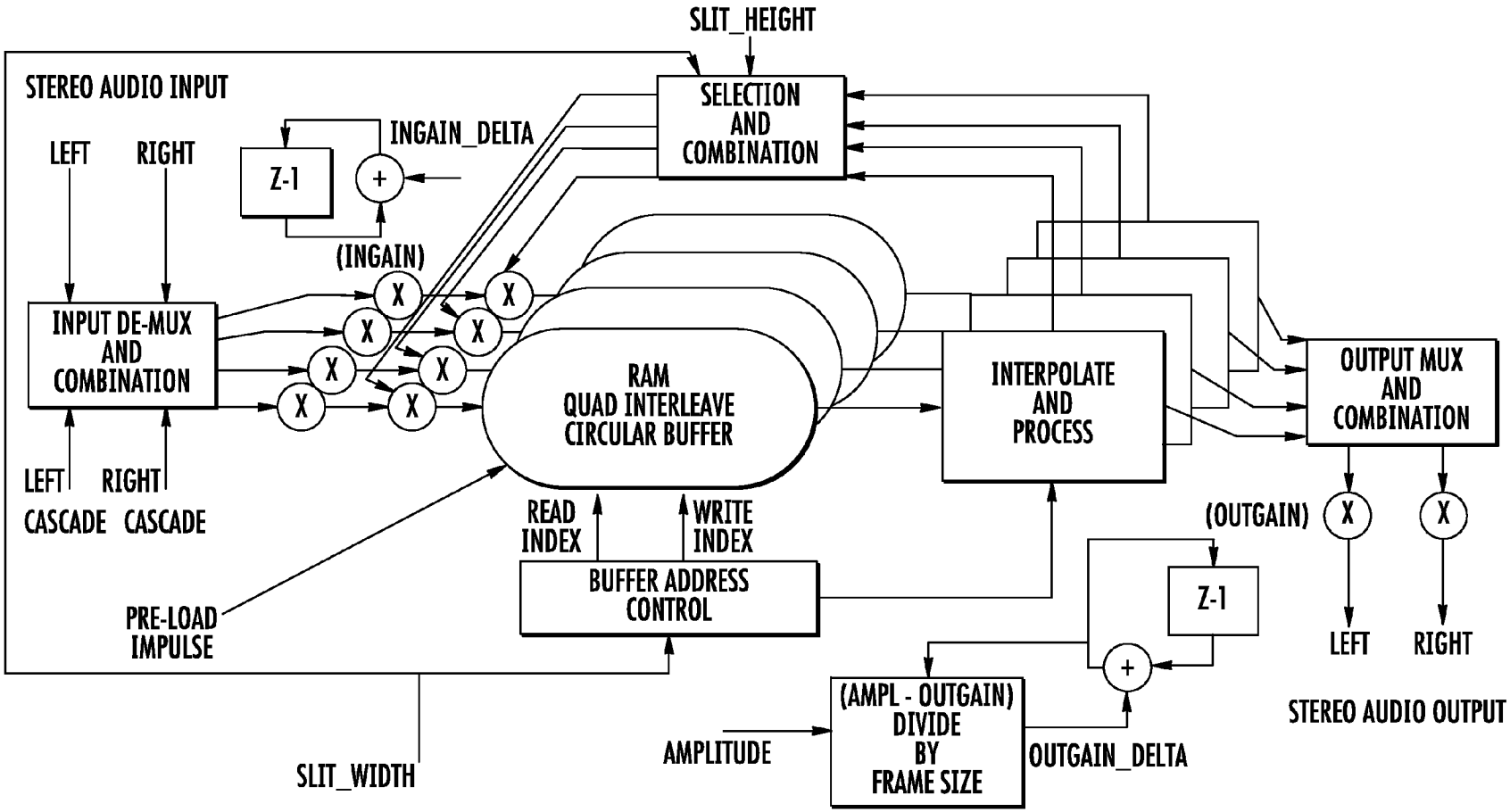
FIG. 4 shows an example of a frequency aperture filter in accordance with an embodiment.

FIG. 4 shows an example of a frequency aperture filter in accordance with an embodiment. In one example embodiment, an input impulse or other initialization energy is preloaded into a multi-channel circular buffer. A buffer address control block calculates successive write addresses to preload the entire circular buffer with impulse transient energy whenever, for example, a new note is depressed on the music keyboard.

In accordance with an embodiment, this buffer is of circular (modulo) type and comprised of four interleave channels of equal modulo-4096 (or other 2^n) length, for simplicity of modulo addressing. Multiple channels are addressed by the same pointer index by adding offsets of 4096, 8192, and 12288, respectively. However, by virtue of the 4-channel interleave arrangement, execution of one single SIMD (Single Instruction Multiple Data) data lookup, provides one address for all four variables simultaneously.

For example, with a SIMD CPU opcode such as the "MOVAPS [EAX], xmm2" instruction in the Intel SSE-capable architecture, with the EAX register having first been preloaded with the write index, four 32-bit floating point values are read from the xmm2 register and placed into the memory address indexed by the EAX register. This happens in as little as a single CPU cycle.

In accordance with an embodiment, Left and Right Stereo or mono audio is de-multiplexed into four channels, based on the combination type desired for the aperture spacing. This is the continuous live streaming audio that follows the impulse transient loading.

After that, continuous, successive write addresses are generated by the buffer address control for incoming combined input samples, as well as for successive read addresses for outgoing samples into the Interpolation and Processing block.

In one example buffer address calculation, the read address is determined by the write address, by subtracting from it a base reference value divided by the read step size. The read step size is calculated from the slit_width input. The pass bands of the filter may be determined in part by the spacing of the read and write pointers, which represent the Infinite Impulse, or feedback portion of an IIR filter design. The read address in this case may have both an integer and fractional component, the later of which is used by the interpolation and processing block.

In accordance with an embodiment, the Interpolate and Process block is used to lookup and calculate a value "in between" two successive buffer values at the audio sample rate. The interpolation may be of any type, such as well known linear, spline, or sine(x)/x windowed interpolation. By virtue of the quad interleave buffer, and corresponding interleave coefficient and state variable data structures, four simultaneous calculations may be performed at once. In addition to interpolation, the block processing includes filtering for high-pass, low-pass, or other tone shaping. The four interleave channels have differing, filter types and coefficients, for musicality and enhancing stereo imaging. In addition, there may be multiple types of interpolation needed at once, one to resolve the audio sample rate range via up-sampling and down-sampling, and one to resolve the desired slit_width.

In accordance with an embodiment, the Selection and combination block is comprised of adaptive stability compensation filtering based on the desired slit_width and slit height, recombining the 4 interleave inputs from the Interpolate and Process block by mixing the various audio channels together at different amplitudes, and calculating and applying the amplitude scaling coefficient based on the slit height input. Adaptive stability compensation filtering is important for maintaining stability of a recursive IIR design at relatively higher values of slit_width and slit height, which may be changing continuously in value.

After interpolation and processing, the audio is multiplexed in the output mux and combination block. The output multiplexing complements both the input de-multiplexing and the selection and combination blocks to accumulate the desired output audio signal and aperture spacing character.

Pitch Dispersion Transform Filter

Figure 5A:
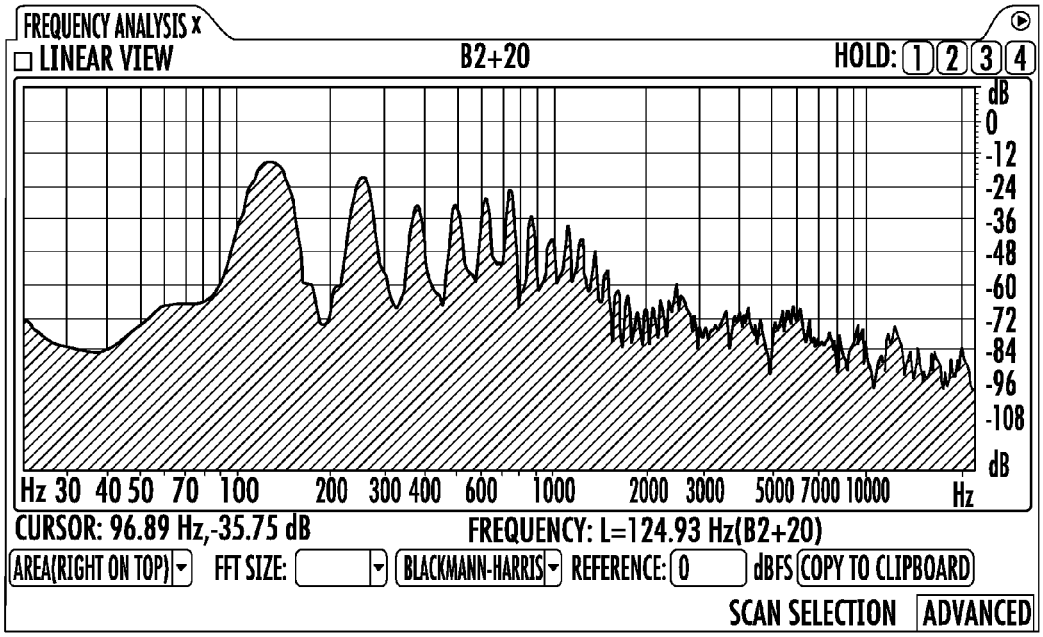
Figure 5B:
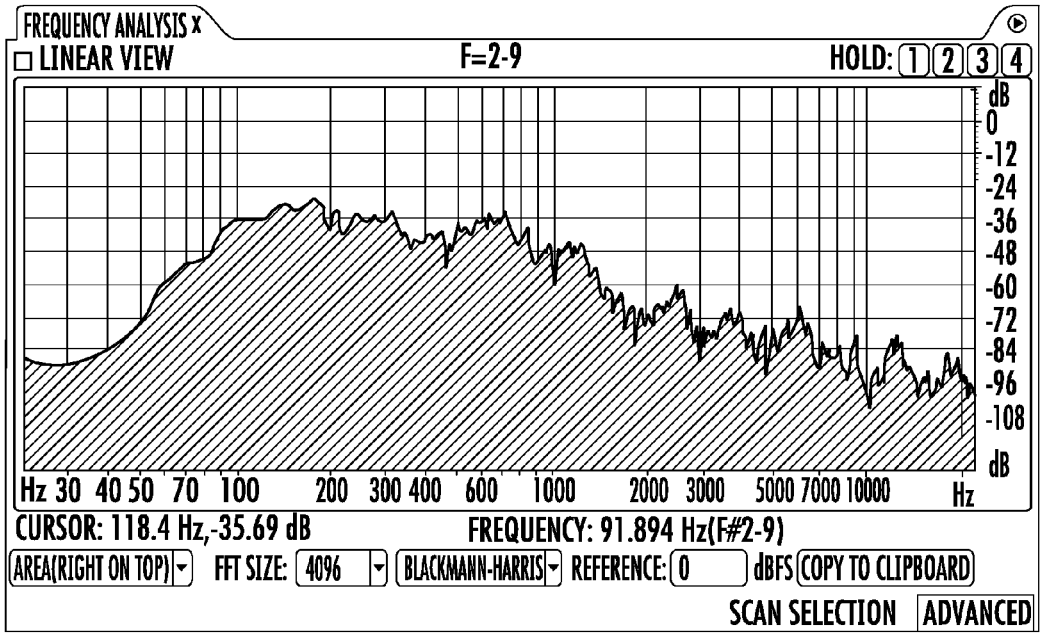
FIG. 5B shows an example of an audio noise spectra, in accordance with an embodiment.

FIG. 5A shows an example of a definite pitch signal, in accordance with an embodiment; while FIG. 5B shows an example of an audio noise spectra, in accordance with an embodiment.

In applications where the incoming audio stream is comprised of frequency peaks and valleys, as in the case of sounds of a definite pitch (e.g. FIG. 5A: DISP_IN.jpg), it is of advantage to remove these by converting them into audio noise spectra (e.g. FIG. 5B: DISP_OUT.jpg), while at the same time attempting to preserve the intelligibility, sibilance, or transient aspect of the original sound.

Each frequency aperture cell in the array will separate noise components into harmonic and inharmonic frequency multiples, therefore an incoming sound with strong frequency peaks and valleys will result in large, frequency-dependent peaks and valleys in output volume, via the incoming frequency bands lining up with the multiple pass band spacing within the cell (or cell array).

Figure 6A:
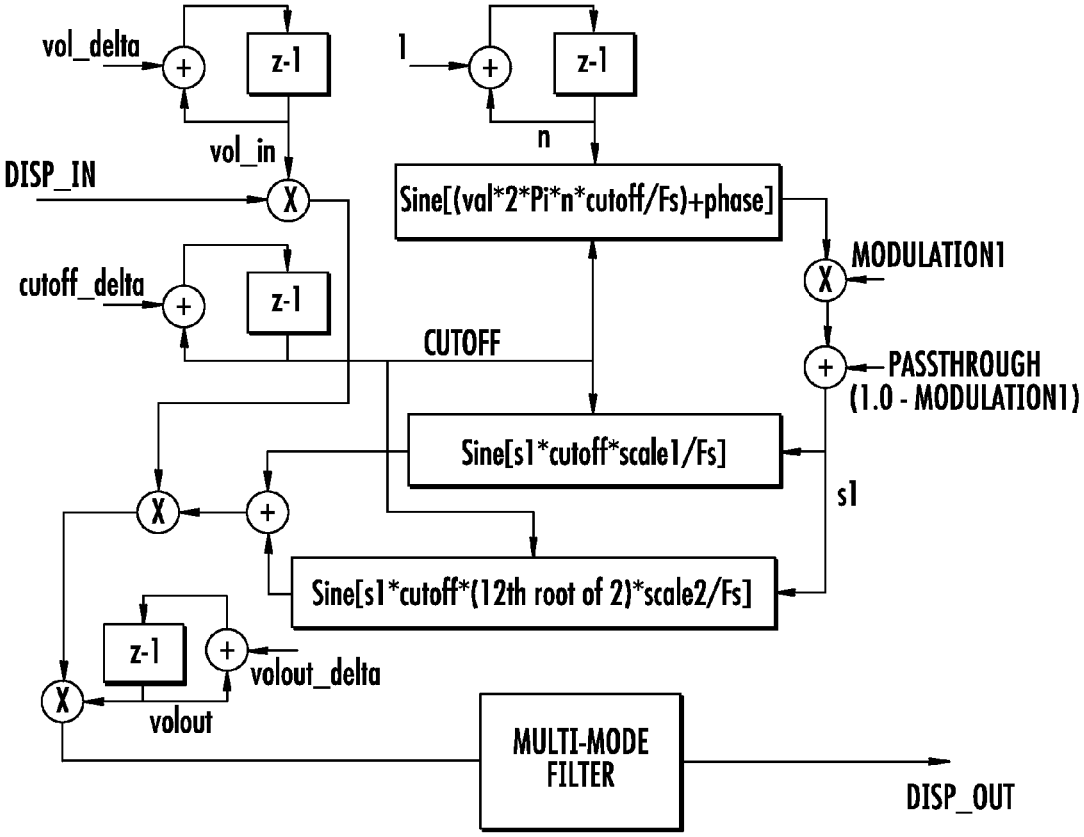
FIG. 6 shows an example pitch disbursement transform filter, in accordance with an embodiment.
Figure 6B:
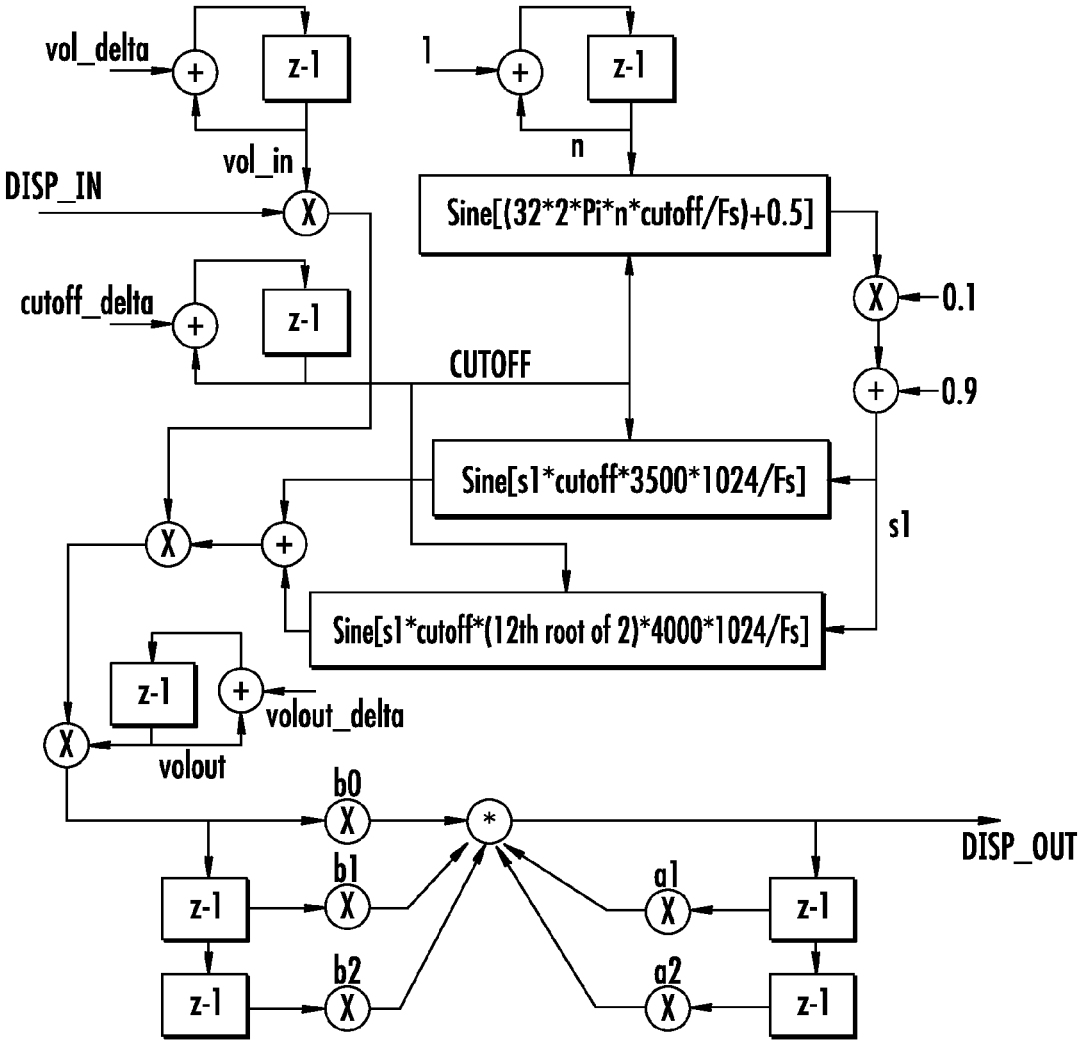

FIG. 6 shows an example pitch disbursement transform filter, in accordance with an embodiment. As shown in FIG. 6, "Pi"=22/7, "($12^{th}$ root of two)"=1.059463094359295264561825294946 3, "Fs"=the sample rate of the digital audio "Sine[ ]" is the mathematical sin of the argument in brackets The section between the "out and DISP_OUT may simply be a HP or other digital multimode filter. The Sine function arguments may also be adjusted to the source audio and offset slightly for enhanced stereo seperation.

Input Audio Signal

The input audio signal can consist of any audio source in any format and be read in via a file-based system or streamed audio. A file-based input may include just the raw PCM data or the PCM data along with initial states of the FAA filter parameters and/or modulation data.

Modulation of the Input Audio Source

The input audio signal itself can be subject to modulation by various methods including algorithmic means (random generators, low frequency oscillation (LFO) modulation, envelope modulation, etc.), MIDI control means (MIDI Continuous Controllers, MIDI Note messages, MIDI system messages, etc.); or physical controllers which output MIDI messages or analog voltage. Other modulation methods may be possible as well.

Figure 7:
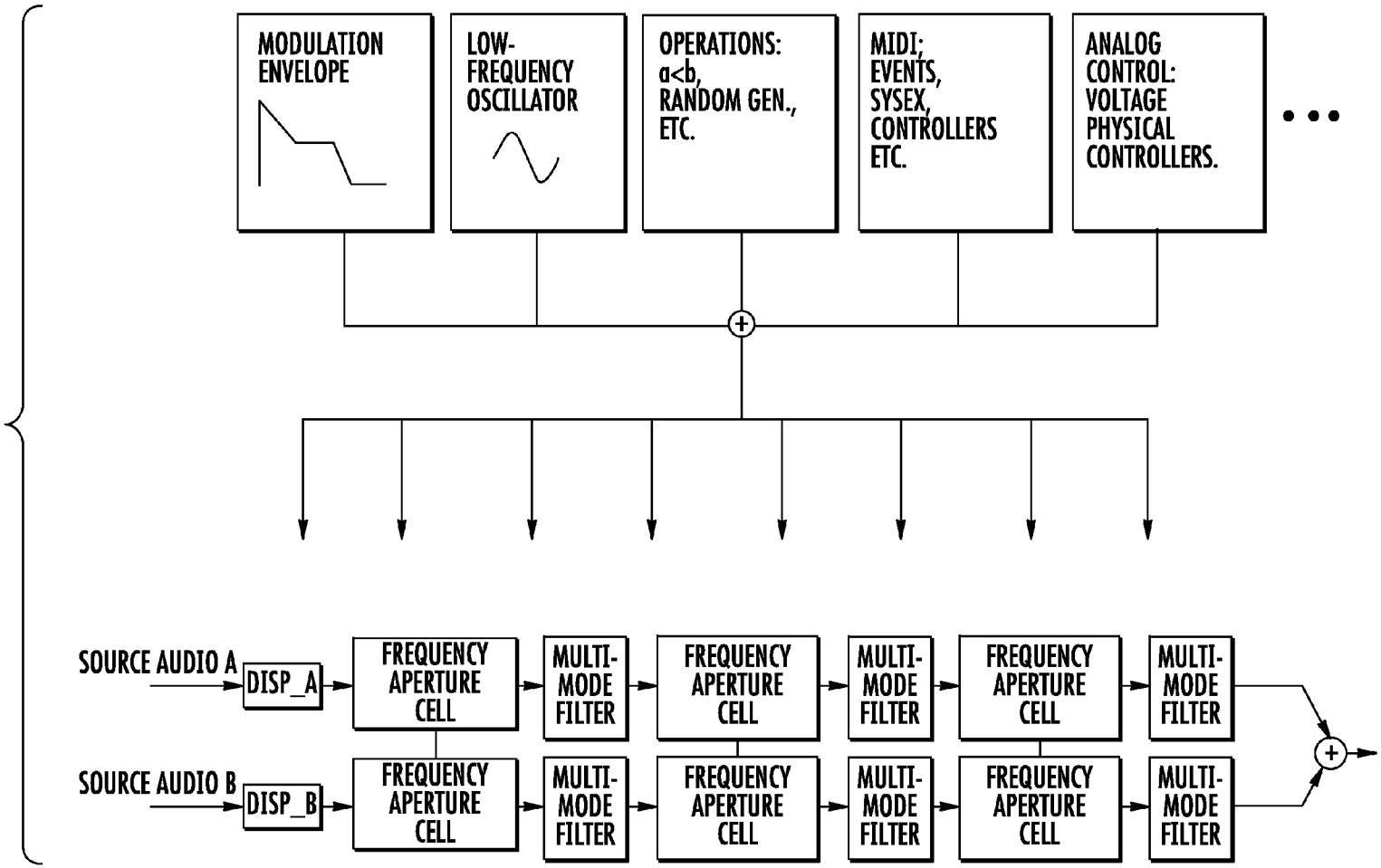
FIG. 7 shows an illustration showing how an audio input source into the FAA synthesizer can be modulated before entering the FAA filters, and how the FAA filters themselves can be modulated in real-time, in accordance with an embodiment.

FIG. 7 shows an illustration showing how an audio input source into the FAA synthesizer can be modulated before entering the FAA filters, and how the FAA filters themselves can be modulated in real-time, in accordance with an embodiment. In particular, FIG. 7 shows how an audio input source into the FAA synthesizer may be modulated before entering the FAA filters. It also shows how the FAA filters themselves can be modulated in real-time.

Hybrid FAA Synthesis

Figure 8:
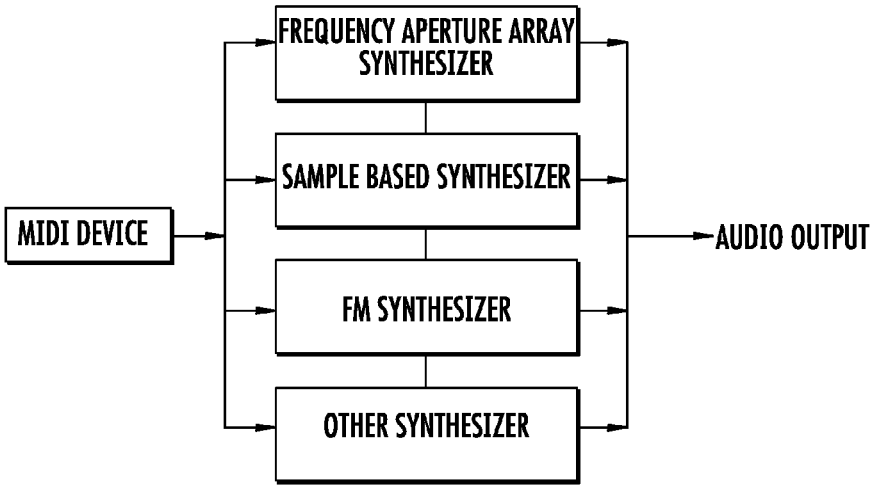
FIG. 8 shows an illustration of how the FAA synthesis can be combined with other synthesis methods, in accordance with an embodiment.
Figure 9:
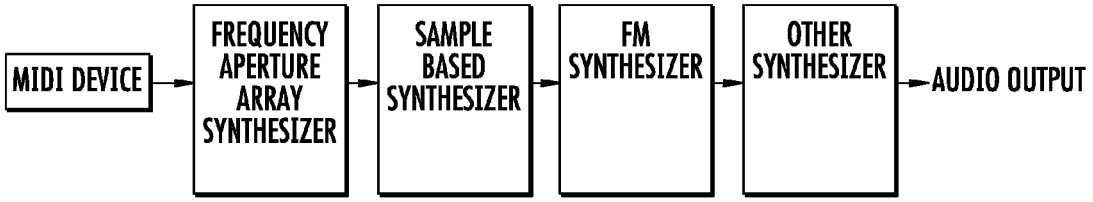
FIG. 9 shows an illustration of how the FAA synthesis can be combined with other synthesis methods, in accordance with another embodiment.

FIGS. 8 and 9 show illustrations of how the FAA synthesis can be combined with other synthesis methods, in accordance with various embodiments.

Console Application

Figure 10:
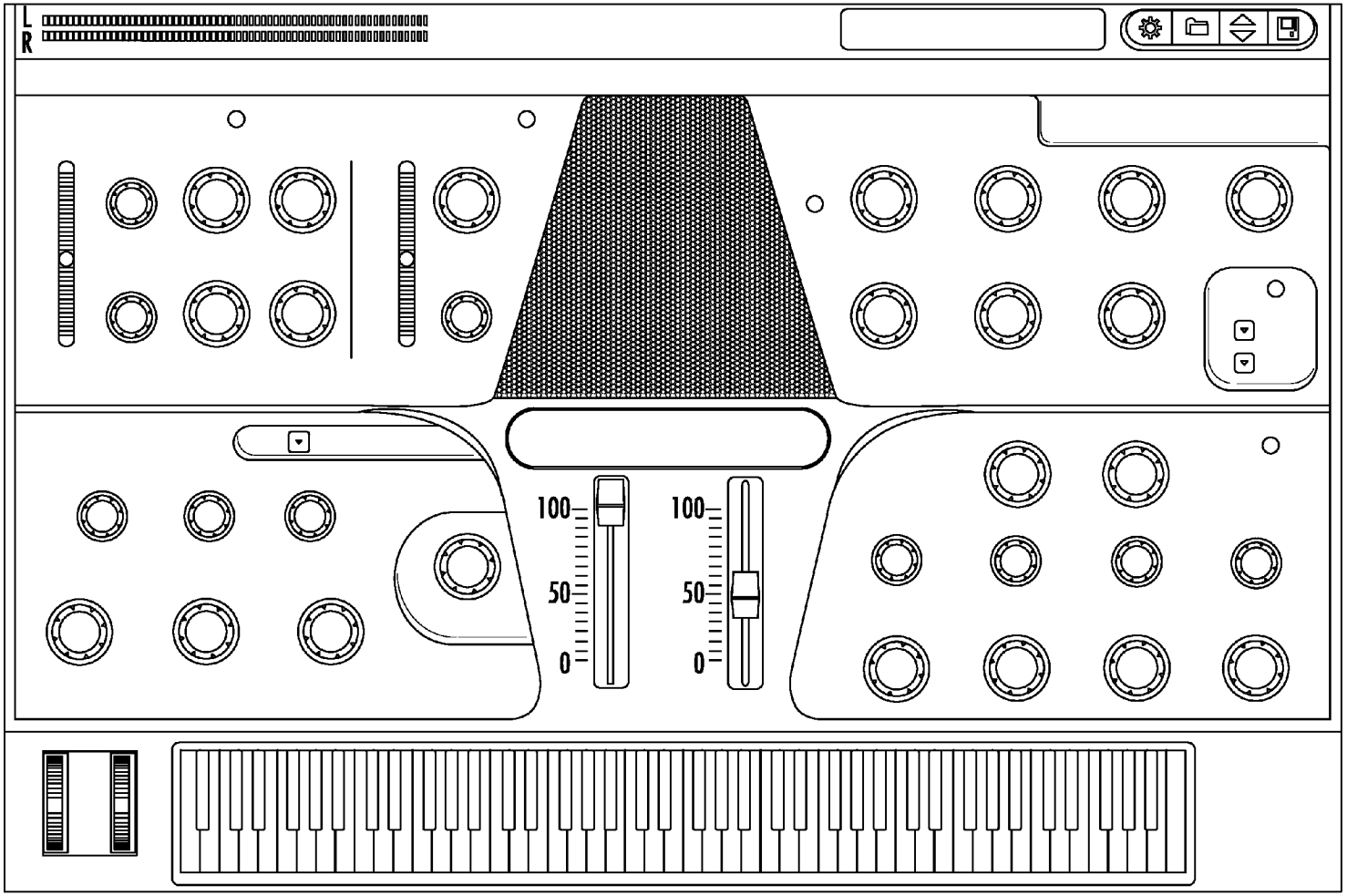
FIG. 10 shows an example console or keyboard-like application for use with the system, in accordance with an embodiment.

FIG. 10 shows an example console or keyboard-like application, which can be used with the system as described above, in accordance with an embodiment.

Additional Applications

The above-described systems and methods can be used in accordance with various embodiments to provide a number of different applications, including but not limited to:

- A system and method that can synthesize pitched, musical sounds from non-pitched, broad-spectrum audio.
- A system and method of combining and arranging frequency aperture cells for extreme efficiency of processing and memory.
- A system and method of transforming audio with discernable pitch and timbre into broad-spectrum noise with no discernable pitch and timbre.
- A system and method for combining the above synthesis with other synthesis methods to create hybrid synthesizers.
- A system and method for modulating individual components of the system using MIDI, algorithmic or physical controllers.
- A system and method for using real-time, streamed audio as an input audio source for the above synthesizer.
- A system and method for vocalizing into the above synthesizer while playing MIDI and having the vocalization re-pitched and harmonized.
- A system and method for inputting any musical audio source, whether file-based or streamed, and re-pitching it and re-harmonizing.
- A system and method for vocalizing into the above synthesizer while playing MIDI and having the synthesizer play a recognizable musical instrument.

The present invention may be conveniently implemented using one or more conventional general purpose or specialized digital computers or microprocessors programmed according to the teachings of the present disclosure. Appropriate software coding can readily be prepared by skilled programmers based on the teachings of the present disclosure, as will be apparent to those skilled in the software art.

In some embodiments, the present invention includes a computer program product which is a storage medium (media) having instructions stored thereon/in which can be used to program a computer to perform any of the processes of the present invention. The storage medium can include, but is not limited to, any type of disk including floppy disks, optical discs, DVD, CD-ROMs, microdrive, and magneto-optical disks, ROMs, RAMs, EPROMs, EEPROMs, DRAMs, VRAMs, flash memory devices, magnetic or optical cards, nanosystems (including molecular memory ICs), or any type of media or device suitable for storing instructions and/or data.

The foregoing description of the present invention has been provided for the purposes of illustration and description. It is not intended to be exhaustive or to limit the invention to the precise forms disclosed. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A system for an audio synthesizer comprising a frequency aperture array, the frequency aperture array comprising:

an array of frequency aperture cells, the frequency aperture cells configured to separate components of input signals into harmonic and inharmonic frequency multiples, wherein the frequency aperture array accepts a sound input, which includes discernible pitch and timbre, transforms the sound input into broad-spectrum noise using a pitch disbursement transform filter, and separates components of the sound input into harmonic and inharmonic frequency multiples.

2. The system of claim 1, wherein the system is configured to synthesize pitched, musical sounds from non-pitched, broad-spectrum audio.

3. The system of claim 1, wherein the system is configured to process the sound input efficiently.

4. The system of claim 1, wherein the broad-spectrum noise has no discernable pitch and timbre.

5. The system of claim 1, further comprising another synthesizing component which is combined with the frequency aperture array to form a hybrid synthesizer.

6. The system of claim 1, further comprising means for modulating the sound input using MIDI control means, algorithmic means, or physical controllers.

7. The system of claim 1, wherein the sound input is a real-time, streamed audio.

8. The system of claim 1, wherein the sound input includes vocalization while a MIDI is played, and the output of the system includes the vocalization re-pitched and harmonized based on the MIDI.

9. The system of claim 1, wherein the sound input is a musical audio source, which is file-based or streamed, and the output of the system includes the musical audio source re-pitched and re-harmonized.

10. The system of claim 1, wherein:

the sound input includes a vocalization and a MIDI, and the output of the system includes sounds having the characteristics of a recognizable musical instrument and is generated based on the vocalization and the MIDI.

11. A method for synthesizing audio, comprising:

receiving a sound input, which includes discernible pitch and timbre;

transforming the sound input into broad-spectrum noise using a pitch disbursement transform filter; and separating components of the sound input into harmonic and inharmonic frequency multiples by utilizing an array of frequency aperture cells configured to separate components of input signals into harmonic and inharmonic frequency multiples.

12. The method of claim 1, further comprising synthesizing pitched, musical sounds from non-pitched, broad-spectrum audio.

13. The method of claim 1, further comprising processing the sound input efficiently based on utilizing a combination of frequency aperture cells.

14. The method of claim 1, wherein the broad-spectrum noise has no discernable pitch and timbre.

15. The method of claim 1, further comprising performing another synthesizing method to form a hybrid synthesizer.

16. The method of claim 1, further comprising modulating the sound input using MIDI control means, algorithmic means, or physical controllers.

17. The method of claim 1, wherein the sound input is a real-time, streamed audio.

18. The method of claim 1, wherein the sound input includes vocalization and a MIDI, and the output of the system includes the vocalization re-pitched and harmonized based on the MIDI.

19. The method of claim 1, further comprising re-pitching and re-harmonizing the sound input.

20. The method of claim 1, further comprising receiving an input of a vocalization and a MIDI, and outputting sounds having the characteristics of a recognizable musical instrument that is generated based on the vocalization and the MIDI.

21. The system of claim 1, wherein the frequency aperture cells are associated with modulators which define slit widths and slight heights for separating components of an input signal into harmonic and inharmonic frequency multiples.

22. The system of claim 1, further comprising a modulator that modulates an input signal of a frequency aperture cell or a modulator that modulates a filter of a frequency aperture cell.

23. The system of claim 22, wherein the modulator of a filter of a frequency aperture cell performs modulation in real-time.

24. The system of claim 22, wherein the modulator of a filter of a frequency aperture cell perform transient impulse scaling.

25. The system of claim 1, wherein a frequency aperture cell includes a frequency aperture filter.

* * * * *

UNITED STATES PATENT AND TRADEMARK OFFICE

CERTIFICATE OF CORRECTION

PATENT NO. : 8,759,661 B2
APPLICATION NO. : 13/218727
DATED : June 24, 2014
INVENTOR(S) : James Edwin Van Buskirk et al.

It is certified that error appears in the above-identified patent and that said Letters Patent is hereby corrected as shown below:

Title Page, Item (75), Line 3 of "Inventors"
"Jason Jordan, Maiden, MA (US);" should read
--Jason Jordan, Malden, MA (US);--

Signed and Sealed this
Fourth Day of November, 2014

Michelle K. Lee

Michelle K. Lee
*Deputy Director of the United States Patent and Trademark Office*